US009322383B2

(12) United States Patent
Sackmann

(10) Patent No.: US 9,322,383 B2
(45) Date of Patent: Apr. 26, 2016

(54) METHOD FOR CLOSED-LOOP CONTROL OF THE TEMPERATURE OF A GLOW PLUG

(71) Applicant: BorgWarner BERU Systems GmbH, Ludwigsburg (DE)

(72) Inventor: Martin Sackmann, Benningen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 672 days.

(21) Appl. No.: 13/785,141

(22) Filed: Mar. 5, 2013

(65) Prior Publication Data

US 2013/0233844 A1 Sep. 12, 2013

(30) Foreign Application Priority Data

Mar. 9, 2012 (DE) ..... 10 2012 102 005

(51) Int. Cl.

| | |
|---|---|
| ***F02P 19/00*** | (2006.01) |
| ***F02P 19/02*** | (2006.01) |
| ***F23Q 7/00*** | (2006.01) |
| ***H05B 1/02*** | (2006.01) |
| ***F02D 45/00*** | (2006.01) |

(52) U.S. Cl.

CPC ..... *F02P 19/021* (2013.01); *F02D 45/00* (2013.01); *F23Q 7/00* (2013.01); *H05B 1/02* (2013.01); *F02P 19/023* (2013.01); *F02P 19/025* (2013.01)

(58) Field of Classification Search

CPC ... F02D 45/00; F23Q 7/001; F23Q 2007/002; F23Q 2007/004; F02P 19/022; F02P 19/025

USPC ..... 219/492, 494, 497, 501, 505; 123/179.6, 624; 701/113

See application file for complete search history.

(56) References Cited

U.S. PATENT DOCUMENTS

| | | | | |
|---|---|---|---|---|
| 8,322,920 | B2 | 12/2012 | Rapp et al. | |
| 2009/0200286 | A1* | 8/2009 | Reissner | F23Q 7/001 219/264 |
| 2009/0289051 | A1* | 11/2009 | Cassani | F02P 19/025 219/497 |
| 2010/0312416 | A1* | 12/2010 | Demirdelen | F02P 19/025 700/300 |
| 2011/0041818 | A1* | 2/2011 | Kernwein | F02P 19/022 123/623 |

FOREIGN PATENT DOCUMENTS

| | | | |
|---|---|---|---|
| DE | 10 2008 007 394 | A1 | 8/2009 |
| DE | 10 2009 047 650 | A1 | 5/2011 |

* cited by examiner

*Primary Examiner* — Hieu T Vo
*Assistant Examiner* — Arnold Castro
(74) *Attorney, Agent, or Firm* — Bose McKinney & Evans LLP

(57) ABSTRACT

A method for controlling the surface temperature of a glow plug. A heating current flowing through the glow plug and a voltage applied to the glow plug are measured, a temperature-dependent control variable is calculated from measured values of the heating current and the voltage using a first calculation rule, a target value of the control variable is calculated from a target temperature using a second calculation rule, the control variable is compared with the target value and, to minimize any deviation, the duty cycle of the pulse-width modulation is changed in accordance with this deviation. A value other than electrical resistance dependent on current and voltage is used as the control variable. The calculation rule in accordance with which this variable is calculated from measured values of current and voltage is provided to carry out the method and is established in each case for a series of glow plugs.

10 Claims, No Drawings

METHOD FOR CLOSED-LOOP CONTROL OF THE TEMPERATURE OF A GLOW PLUG

RELATED APPLICATIONS

This application claims priority to DE 10 2012 102 005.1, filed Mar. 9, 2012 which is incorporated herein by reference in its entirety.

BACKGROUND

This disclosure relates to a method for closed-loop control of the surface temperature of a glow plug.

In known methods, the electrical resistance of the glow plug is used as a control variable. Here, the electrical resistance is calculated from continuously measured values of the heating current and of the electrical voltage and is compared with a target value, which is established from a predefined target temperature by means of a temperature/resistance characteristic curve.

The quality of the temperature control achieved in this way with known methods is poor, however. This is true in particular for ceramic glow plugs which show large variations of the cold resistance as a result of the manufacturing process.

SUMMARY

The present invention provides a way in which the surface temperature of a glow plug can be controlled more precisely.

With a method according to this disclosure, it is not the electrical resistance, but another variable calculated from current and voltage that is used as the control variable. The calculation rule in accordance with which this variable is calculated from measured values of current and voltage is provided for the method, for example, by the producer of the glow plugs or of the engine. The calculation rule is established individually for each series of glow plugs. This calculation rule will be referred to hereinafter as a first calculation rule.

Series are sometimes also referred to as types or models. A series is to be understood to mean glow plugs that differ from one another merely by deviations within production tolerances. Ideally, all glow plugs in a series should thus match in terms of all properties and dimensions. Manufacturing tolerances are unavoidable however, which is why glow plugs in a series differ within the scope of manufacturing tolerances. This is true in particular for the cold resistance of ceramic glow plugs, which are subject to considerable variations as a result of the manufacturing process.

A second calculation rule links the result of the first calculation rule, that is to say the control variable, to the surface temperature. The second calculation rule is used in a method according to this disclosure in order to assign each target value of the surface temperature a target value of the control variable. The second calculation rule is established for a specific glow plug by a control unit that brings the temperature of the glow plug to a target value by closed-loop control. The control plug establishes the second calculation rule by fitting a function containing at least one adaptable parameter. Fitting a function means to assign such a value to any adaptable parameter or parameters that the function approximates the data as well as possible. The surface temperature of said glow plug is then controlled by the control unit to a target value.

The first calculation rule is established, for example, by the glow plug producer or the engine producer, for a plurality of glow plugs in a series that convey a typical image of the manufacturing tolerances in this series. The glow plugs in question, for which the first calculation rule is established, can be selected randomly from the series or can be selected deliberately, provided that the properties of the selected glow plugs reflect the distribution of properties in the series as caused by the manufacturing process, that is to say for example demonstrate a scattering of values of the cold resistance typical for the series.

For each of the selected glow plugs it is then determined which temperature appears after a heating phase when a given voltage is applied and which heating current then flows. This process is repeated for several voltages. This can be achieved by taking measurements at actual, existing glow plugs. It is possible, however, on the basis of corresponding values to establish simulation calculations for glow plugs, as are to be expected under consideration of manufacturing tolerances for the series. The values are preferably established, however, by measurements, for example by measuring the heating current at a predefined voltage under static conditions. These measurements are preferably taken in an engine or a test stand, which generates an engine-like environment for the glow plugs. Here, it is advantageous if the test stand specifies a defined gas flow and allows the speeds of the incident flow to be changed in order to simulate different engines.

The calculated or measured values are combined to form triples. Each triple contains a temperature value, a voltage value and a current value; that is to say combines values that occur together in a glow plug.

The triples are then used to fit adaptable parameters of a fit function. The fit function contains at least two adaptable parameters and assigns a temperature value to each combination of a voltage value with a current value. This fit function is composed of two functions, which each contain at least one adaptable function parameter. A first function assigns a function value to a combination of a voltage value with a current value. The second function assigns a temperature value to each function value of the first function.

The fitting of a fit function is sometimes also an equalization or regression calculation. When a fit function is fitted, values having the property of delivering the smallest possible deviation of function values of the fit function from the points of a data set are determined for the adaptable function parameters of the fit function. In the present case, after fitting of the function parameters, the fit function is to assign the current and voltage values of the triples to temperature values deviating as little as possible from the temperature values of the triples.

It is vital that the fit function is fitted such that the first function is a fit for all glow plugs in a series, whereas the second function is only fitted to triples of a single glow plug. The values assigned by fitting the fit function to the adaptable parameter(s) of the first function are thus valid for all glow plugs in a series. In contrast, at least one adaptable parameter of the second function is given a value that is valid for just one specific glow plug. That adaptable parameter of the second function is given a different value for another glow plug.

In the following, a function wherein the adaptable parameter(s) have been given a specific value by a fitting process is called an adapted function. Thus, the adapted first function is the first function mentioned above wherein each adaptable parameter has a specific value. Likewise, the adapted second function is the second function mentioned above wherein each adaptable parameter has a specific value.

Considering all triples, the deviation of the function values, which the fit function delivers when applied to the current and voltage values of the triples, from the temperature values of the triples is thus to be minimal; in particular, the sum of the squares of the deviation of the function values, which the fit function delivers when applied to the current and voltage values of each triple, from the temperature values of the respective triple is thus to be minimal. The adaptable function parameter(s) of the first function is/are selected identically for all triples. At least one adaptable function parameter of the second function is separately given a value for all triples of the same glow plug in order to achieve the best possible adaptation, that is to say in particular minimizes the sum of the squares of the deviation of the function values, which the fit function delivers when applied to the current and voltage values of each triple, from the temperature values of the triple in question.

The calculation rule thus obtained by fitting the first function is the first calculation rule. It is the same for all glow plugs in the series. The calculation rule obtained by fitting the second function is only valid in each case for one specific glow plug. With different glow plugs, different calculation rules obtained from the second function thus apply.

With the method according to this disclosure, the second calculation rule has to be determined by a control unit of the glow plug of which the surface temperature is to be controlled while the engine is running. To this end, a defined voltage is applied to the glow plug and the heating current produced with this nominal voltage is measured. For example, this defined voltage can be a nominal voltage specified by the producer for an operating temperature. The first calculation rule is then used to calculate a value from the defined voltage and the heating current measured therewith. This value is then used to fit the second function. The at least one adaptable parameter of the second function is thereby selected such that the second function delivers a temperature value for the value calculated with the first calculation rule from the nominal voltage and the heating current measured therewith under static conditions, said temperature value matching a temperature value assigned to the defined voltage. This defined voltage is preferably a nominal voltage specified by the producer for an operating temperature. This operating temperature is then the temperature assigned to the defined voltage.

The adapted second function determined in this way then has to be inverted in order to obtain the second calculation rule for this glow plug. Specifically, the adapted second function assigns a temperature value to each value of the control variable. The second calculation rule, however, assigns a value of the control variable to each temperature value. The inverse function of the adapted second function, that is to say the second function with values of its adaptable function parameters determined by fitting, is thus the second calculation rule.

To determine the second calculation rule, the heating current produced under static conditions with application of a nominal voltage, which is also referred to as a steady-state current, can be measured and then used to determine the second calculation rule. It is also possible to measure the current during the heating process, for example after predefined intervals over time. In this case, an individual measured value of current or a plurality of values measured in succession, that is to say the curve shape of the current profile or its deviation over time, can then be used for adaptation. The time required to determine the second calculation rule can thus be reduced since there is not necessarily a need to wait until the conditions at the glow plug are static.

A target value of the control variable can then be calculated from a predefined target temperature using the second calculation rule thus obtained. This target value is then compared with an actual value of the control variable, which is calculated from actual values of the heating current and the electrical voltage. The duty cycle of the pulse-width modulation, with which the electrical voltage is applied to the glow plug, is then adjusted in accordance with this comparison in order to minimize the deviation of the actual value of the control variable from the target value of the control variable. For this purpose, a PI or PID method can be used, that is to say a proportional-integral control method or a proportional-integral-differential control method.

DETAILED DESCRIPTION

The embodiments described below are not intended to be exhaustive or to limit this disclosure to the precise forms disclosed in the following detailed description. Rather, the embodiments are chosen and described so that others skilled in the art may appreciate and understand the principles and practices of the present invention.

According to this disclosure, the adaptable function parameter of the first function and at least one of the adaptable function parameters of the first function is an exponent, in particular an exponent of the voltage. For example, the first function may contain a function term of the form $U^p/1$, wherein U is the electrical voltage, I is the electrical current and p is an adaptable function parameter not equal to 1. In this way an extraordinarily stable control variable hardly affected by unavoidable measurement errors of the current and voltage can be calculated.

The first function may contain two adaptable function parameters, for example, two exponents as adaptable function parameters. It is particularly advantageous if the first function contains a function term $(U^p/I)^q$, wherein p and q are adaptable function parameters. Here, it is important that p is different from 1. This means that a value unequal to 1 is used for p in the specific calculation rule determined by fitting the first function. The function term is thus not a function of the electrical resistance. An extraordinarily stable control variable hardly affected by unavoidable measurement errors of the current and voltage can thus be calculated with the function parameter q.

The first function may additionally contain further function terms, but any such terms are usually of subordinate importance in the function or value range relevant for the temperature control of glow plugs. Since the on-board power supply voltage of vehicles is generally approximately 12 volt and in commercial vehicles is approximately 24 volt, the relevant functional range of the voltage is the range from 0 to 14 volt or 0 to 24 volt. Heating currents are typically no greater than approximately 100 amp, and the surface temperature of glow plugs is no more than 1400° C. With electrical voltages of less than 24 volt and heating currents of no more than 100 amps, the function term $(U^p/I)^q$ of the first function should thus make up at least half of the function value, preferably at least 90% of the function value of the first calculation rule.

The second function may be a polynomial, for example. Terms of higher order are usually of subordinate importance in accordance with these teachings. The second function may therefore be selected with very good results as a linear function.

In accordance with an advantageous refinement of this disclosure, the second function contains at least one adaptable function parameter, which has been determined by the producer of the glow plugs by adaptation, that is to say a fitting process. For example, at least one adaptable function parameter of the second function can be determined together with the adaptable function parameter or the adaptable function parameters of the first function in a uniform manner for all glow plugs in a series. The second function then additionally has at least one further adaptable parameter, which has to be determined separately for each glow plug. For example, the second function may contain a constant term and a term proportional to the temperature. In this case, the proportionality constant and possibly further temperature-dependent terms of the second function can be determined together with the adaptable function parameter(s) of the first function in a uniform manner for all glow plugs. Merely the constant term, that is to say the addition constant, then remains as an adaptable function parameter of the second function, which then has to be determined individually for each given glow plug, for example by a control unit of the glow plug.

For example, a target value of the control variable in the form of $a+bT_{targ}$ can be calculated from a target value of the temperature $T_{targ}$, wherein the function parameter b can be provided globally for all glow plugs in a series and for example can be determined within the scope of the adaptation of the fit function, which is a composition of the first function and the second function. The control unit of a glow plug can then establish the function parameter, a, by applying a nominal voltage $U_{nom}$ specified by the producer for an operating temperature $T_{nom}$ to the glow plug in question and by measuring the heating current I produced with this nominal voltage under static conditions. A value that is equated to the term $a+bT_{nom}$ can then be calculated from the nominal voltage $U_{nom}$ and the heating current I measured therewith using the first calculation rule in order to determine the parameter a.

In accordance with a further advantageous refinement, the duty cycle of the pulse-width modulation is determined using a PI or PID control method. To correct an actual value of the control variable indicating that the surface temperature of the glow plug is greater than the target temperature, a greater proportional factor is preferably used than for correction of an actual value of the control variable indicating that the surface temperature is less than the target temperature. A predefined target temperature is thus advantageously exceeded much more rarely and only to a much smaller extent than with a conventional PI or PID method, with which the same proportional factor is always used. If the target temperature is exceeded, this may lead to damage of the glow plug as a result of overheating. Due to the measures according to this disclosure, such damage can be avoided and the service life of the glow plug can thus be extended. This aspect of this disclosure can also be used advantageously independently of the selection of the control variable, that is to say in particular even with conventional control methods, for which the electrical resistance of the glow plug is used as the control variable.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for closed loop control of the surface temperature of a glow plug, which is heated by a pulse-width modulation method, comprising:

measuring a heating current flowing through the glow plug and a voltage applied to the glow plug;

using a first calculation rule to calculate a temperature-dependent control variable from measured values of the heating current and the voltage;

using a second calculation rule to calculate a target value of the control variable from a target temperature;

comparing the control variable with the target value and, in order to minimize deviation found by this comparison, the duty cycle of the pulse-width modulation is changed according to the deviation;

wherein:

the control variable is a variable different from the electrical resistance and is calculated in accordance with the first calculation rule from measured values of heating current and voltage, said calculation rule having been established beforehand for all glow plugs in a series by establishing a plurality of triples for a plurality of glow plugs of a series by determining which glow plug temperature T arises upon applying various electrical voltages U as well as the heating current I that then flows, said triples each containing a temperature value, a voltage value and a current value, and by fitting a fit function to these triples, which contains at least two adaptable function parameters and assigns a temperature value to a combination of a voltage value with a current value, and thereby determining a value of each adaptable function parameter, wherein the fit function is a composition of a first function, which contains at least one adaptable function parameter and assigns a function value to a value pair consisting of a voltage value and a current value, and of a second function, which contains at least one adaptable function parameter and assigns a temperature value to a function value of the first function, and a value of each adaptable parameter of the first function has been determined in a uniform manner for all glow plugs of a series by fitting the first function to the triples and the first calculation rule has thus been obtained as the fitted first function, whereas a value of the at least one adaptable parameter of the second function has been determined separately for each glow plug by fitting to at least one triple established by measurements taken at this glow plug, wherein the second calculation rule is determined for the glow plug of which the temperature is to be controlled by applying a defined voltage to this glow plug and measuring the heating current produced with this voltage, calculating a value from this voltage and the heating current measured therewith using the first calculation rule and then obtaining the second calculation rule by fitting the second function to this value and a temperature assigned to the defined voltage.

2. The method according to claim 1, wherein the defined voltage applied to the glow plug to determine the second calculation rule is a nominal voltage specified by the producer for an operating temperature.

3. The method according to claim 1, wherein the adaptable function parameter or at least one of the adaptable function parameters of the first function is an exponent.

4. The method according to claim 1, wherein the first function has at least two adaptable function parameters.

5. The method according to claim 4, wherein the first function contains two exponents as adaptable function parameters.

6. The method according to claim 1, wherein the first function contains a function term $(U^p/I)^q$, wherein p and q are adaptable function parameters and p is not equal to 1 in the first calculation rule determined by fitting of the first function.

7. The method according to claim 1, wherein the second function contains at least one adaptable function parameter, which has been determined together with the adaptable function parameter or the adaptable function parameters of the first function in a uniform manner for all glow plugs in a series, and at least one further function parameter, which has been determined separately for each glow plug by adaptation to the triples established by measurements taken at these glow plugs.

8. The method according to claim 7, wherein the further function parameter of the second function is an addition constant.

9. The method according to claim 1, wherein the second function is a linear function.

10. The method according to claim 1, wherein the duty cycle of the pulse-width modulation is determined using a PI or PID control method, wherein, to correct an actual value of the control variable indicating that the surface temperature is greater than the target temperature, a greater proportional factor is used than for correction of an actual value of the control variable indicating that the surface temperature is less than the target temperature.

* * * * *